US005486117A

United States Patent [19]

Chang

[11] Patent Number: 5,486,117

[45] Date of Patent: Jan. 23, 1996

[54] LOCKING SYSTEM FOR AN ELECTRICAL CONNECTOR ASSEMBLY

[75] Inventor: Wei-Sun Chang, Taipei, Taiwan

[73] Assignee: Molex Incorporated, Lisle, Ill.

[21] Appl. No.: 287,987

[22] Filed: Aug. 9, 1994

[51] Int. Cl.[6] ..... H01R 13/627

[52] U.S. Cl. ..... 439/357

[58] Field of Search ..... 439/474, 352, 439/347, 350, 351, 353, 354, 357, 607, 180, 610, 603, 324

[56] References Cited

U.S. PATENT DOCUMENTS

| | | | |
|---|---|---|---|
| 3,680,033 | 7/1972 | Kawai | 439/350 |
| 3,990,727 | 11/1976 | Gallagher | 439/603 X |
| 4,026,624 | 5/1977 | Boag | 439/357 |
| 4,435,033 | 3/1984 | Gansert et al. | 439/350 |
| 4,564,252 | 1/1986 | Kato et al. | 339/91 R |
| 4,632,492 | 12/1986 | Yamada | 439/350 X |
| 4,684,192 | 8/1987 | Long et al. | 439/374 |
| 4,762,505 | 8/1988 | Asick et al. | 439/347 |
| 4,838,810 | 6/1989 | Yoshimura et al. | 439/358 |
| 4,936,793 | 6/1990 | Uchida | 439/357 |
| 4,961,711 | 10/1990 | Fujiura et al. | 439/357 |
| 5,088,932 | 2/1992 | Nakamura | 439/350 |
| 5,110,302 | 5/1992 | Kobler | 439/357 |
| 5,178,556 | 1/1993 | Chen | 439/357 |
| 5,197,901 | 3/1993 | Hashiguchi | 439/352 |
| 5,201,669 | 4/1993 | Lin | 439/357 |
| 5,207,586 | 5/1993 | MacGregor et al. | 439/76 |
| 5,234,357 | 8/1993 | Yamaguchi | 439/354 |
| 5,277,627 | 1/1994 | Matsuzaki | 439/677 |
| 5,292,258 | 3/1994 | Sakurai | 439/352 |
| 5,397,246 | 3/1995 | Defibaugh et al. | 439/352 |

FOREIGN PATENT DOCUMENTS

| | | | |
|---|---|---|---|
| 108608 | 5/1984 | European Pat. Off. | 439/357 |
| 2708998 | 9/1978 | Germany | 439/357 |
| 2909616 | 9/1980 | Germany | 439/357 |
| 64-31395 | 2/1989 | Japan . | |
| 5242926 | 9/1993 | Japan . | |

OTHER PUBLICATIONS

Honda Tsushin Kogyo Co. Ltd. Drawing Entitled "Cable Assembly Female 15 Position Connector".

Hirose Data Sheet Entitled "3200 Series 15 Position I/O Connector for PCMCIA PC Card Applications".

AMP Incorporated Drawing No. 93–1815–16 (p. 2 of 2).

*Primary Examiner*—William Briggs

*Attorney, Agent, or Firm*—Stacey E. Caldwell

[57] ABSTRACT

A locking system is provided for an electrical connector assembly which includes first and second electrical connectors. The first connector includes a housing having a mating face and a latching surface facing in a direction generally opposite the mating face. The second connector includes a housing having a complementary mating face for interfacing with the mating face of the first connector and a metal spring latch arm cantilevered from the second connector, with a hook portion for latchingly engaging the latching surface of the first connector. The latch arm is located for manual deflection to move the hook portion out of engagement with the latching surface to allow unmating of the connectors with minimal force. The hook portion is radiused therefore deflecting the latch arm in response to an unmating force applied directly to the connectors, i.e. without manual deflection of the latch arm, that is greater than the minimal force.

9 Claims, 4 Drawing Sheets

LOCKING SYSTEM FOR AN ELECTRICAL CONNECTOR ASSEMBLY

FIELD OF THE INVENTION

This invention generally relates to the art of electrical connectors and, particularly, to a locking system for an electrical connector assembly, providing minimal mating and unmating forces by way of manual actuation of the locking system, as well as allowing direct unmating, i.e. without manual actuation of the locking system, by a force greater than the minimal force.

BACKGROUND OF THE INVENTION

There are a variety of locking or latching designs or systems in the electrical connector art for positively locking a first connector to a second connector or other mating structure. In some latching systems, it is desirable to have high unmating forces between the connectors, to prevent inadvertent disconnection of the mating structures, however, at the same time, it is undesirable to have excessive mating forces which might damage the connectors upon coupling them. To address these seemingly conflicting force requirements, some connector latching systems have incorporated manually actuatable latches wherein the latches of one connector are in a locked and undeflected state when mated to a second connector, and yet the connectors are easily unmated upon manual deflection or depression of the latches by a user. Such latches often are molded integrally with one of the connector housings, such as on the sides of the housing. This type of latching system has its disadvantages, however. Because of the stress levels on the latches during repeated actuation, and because of the tendency of users to unmate or attempt to unmate the connectors without actuating the latches, plastic latches are often susceptible to damage or breakage. Therefore, secondary metal latches often are used to increase the latch life and provide integrity to the latching structure. A manually actuatable portion of the metal latch may be overmolded or otherwise covered in plastic to minimize local stresses on the metal latch as well as to locate the latch within a connector housing.

There are various connector applications wherein the above latching systems, including metal latching systems, have encountered problems. For instance, in the case of cable assemblies incorporating input/output (I/O) connectors which attach to one end of an IC or memory card to couple an underlying computer (e.g. a lap top or a notebook computer) to an external device (such as a modem or facsimile), the I/O cable assembly may be transported and used in a non-conventional or non-office type environment. Under such circumstances, it is desirable to have a positive latching system between the cable assembly I/O connector and the mating connector on the IC card for various reasons. First, the lock minimizes, and may even prevent, inadvertent disconnection of the two connectors, which disconnection might interfere with data transfer or signal processing or the like. Second, the lock may provide an audible click, tactile feedback or other sensory indication to alert a user that a complete connection has been made in order to alert a user that a program or particular data-reading function can commence.

However, given the propensity of users to attempt to hastily remove the cable assembly from the IC card without actuating the latch structure, and given the fact that various computers currently used are portable and therefore operate in unconventional environments, it also is desirable to have a connector latching structure which permits disengagement of the connectors without manually actuating or releasing the latching structure. In other words, if a user hastily pulls on or trips over the cable assembly, and the connector latching structure does not release, the computer can fall to the floor or otherwise be damaged.

From the foregoing, it can be understood that if a connector latching structure can only be disconnected by manual actuation of the latches, the connector latching structure is prone to be damaged, broken or rendered ineffective, or the computer or IC card may be damaged or broken, which may even cause injury to a user. Accordingly, there is a need for a connector latching structure which allows minimal mating and unmating forces if desired (i.e. actuated), but which also permits unmating of the connectors with a given acceptable force greater than the minimal force without actuation of the connector latching structure. This invention is directed to a locking system that meets those requirements and solves the problems outlined above.

SUMMARY OF THE INVENTION

An object, therefore, of the invention is to provide a new and improved locking system of the character described above, for an electrical connector assembly.

In the exemplary embodiment of the invention, a first electrical connector includes a housing having a mating face and a latching surface facing in a direction generally opposite the mating face. A second electrical connector includes a housing having a complementary mating face for interfacing with the mating face of the first connector and a metal spring latch arm cantilevered from a rearward portion of the second connector, with a hook portion of the latch arm latchingly engageable with the latching surface of the first connector. The latch arm is located for manual deflection to move the hook portion out of engagement with the latching surface to allow unmating of the connectors with a minimal force. The hook portion is generally radiused and therefore intersects the latch shoulder at an oblique angle which causes deflection of the latch arm in response to a force applied directly to the connectors opposite the direction of insertion and greater than the minimal force.

As disclosed in the preferred embodiment herein, a pair of latch arms are positioned on the second connector, a first latch arm is cantilevered from one side of the housing of the second connector, and a second latch arm is cantilevered from the opposite side of the housing, whereby both latch arms can be manually deflected by a pinching action against the opposite sides of the housing. The radiuses and the angles which define the hook portions of the latch arms in turn define the interference between the hook portions and the complementary latching surfaces and the consequent mating and unmating forces. Base portions of the latch arms are overmolded by portions of the housing of the second connector.

Other features of the invention include the provision of anti-overstress means on the housing of the second connector to confine the range of deflection of the latch arms away from the housing. Distal ends of the latch arm include oblique lead-in lips for engaging portions of the housing of the first connector and biasing each latch arm to a deflected position upon coupling the connectors.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
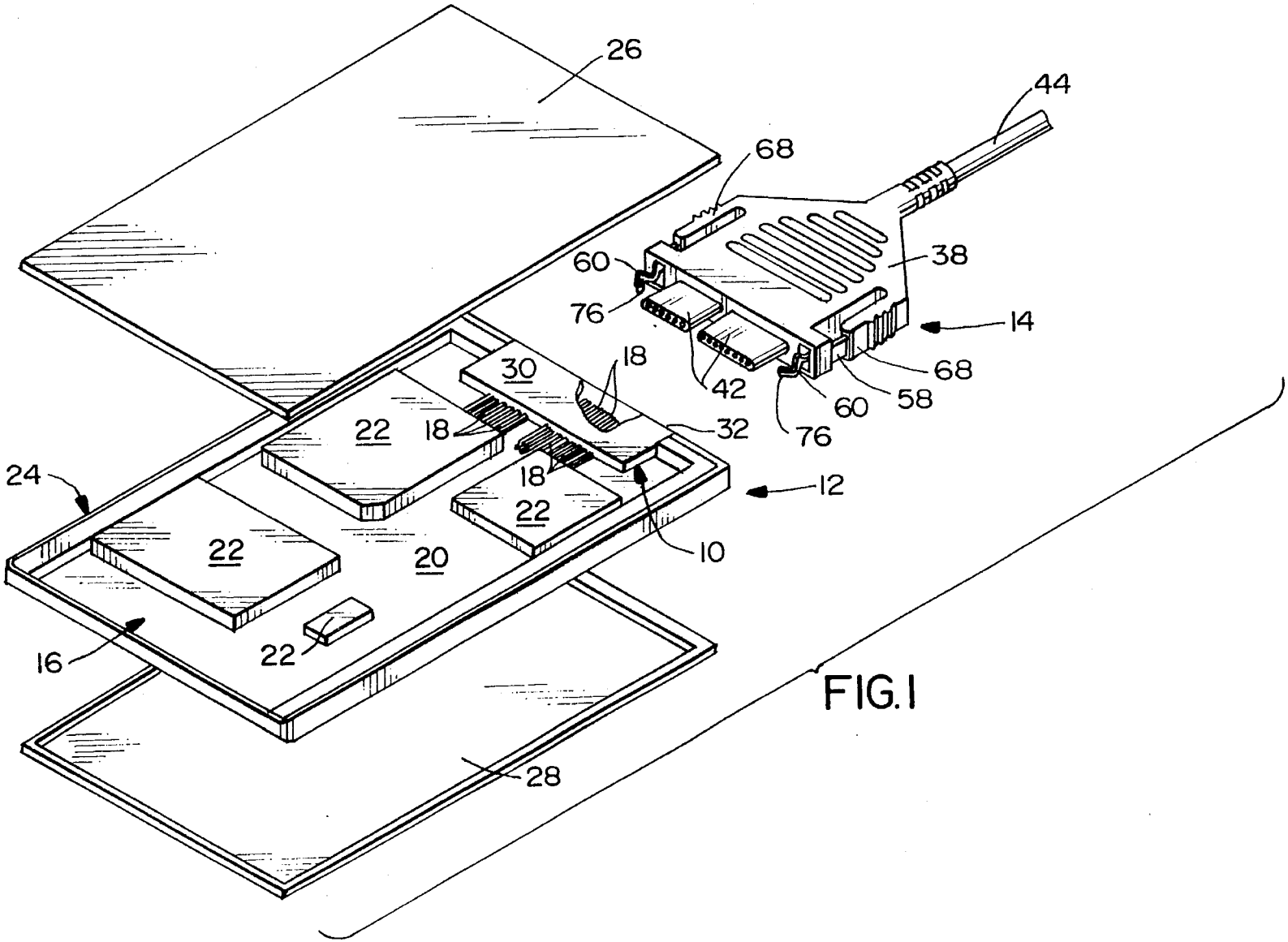
FIG. 1 is an exploded perspective view of the elements of an IC card in conjunction with a mating I/O connector, embodying the concepts of the invention.

Referring to the drawings in greater detail, and first to FIG. 1, the locking system of the invention is incorporated between a receptacle connector, generally designated 10, of an IC card, generally designated 12, and a mating I/O connector, generally designated 14. The IC card may be a data input device, such as a memory card, for connection to an underlying electronic apparatus or storage device, such as a word processor, personal computer or other electronic apparatus (not shown), through an electrical connection or interface established between receptacle connector 10 and I/O connector 14. The data stored in memory card 12 is transferred to the underlying electronic apparatus through the terminals within receptacle connector 10 which is mounted to a circuit board assembly, generally designated 16.

Receptacle connector 10 is elongated and mounts a plurality of input terminals 18. The terminals mechanically and electrically engage contact pads (not shown) on a circuit substrate 20 of circuit board assembly 16. Various electrical components or circuit elements 22 are surface mounted on substrate 20, along with circuit traces (not shown) leading to the contact pads near the front of the substrate which are mechanically and electrically coupled to terminals 18. Receptacle connector 10 is interconnectable with I/O connector 14 through which data stored in circuit board assembly 16 is transferred. The circuit board assembly, along with receptacle connector 10, may be mounted within a generally rectangular frame, generally designated 24. A top panel or cover 26 is fixably secured to the top of the frame, and a bottom panel or cover 28 is fixably secured to the bottom of the frame.

The above description of circuit board assembly 16 is generally conventional, and, consequently, the depiction of the circuit board assembly is somewhat schematic. However, it should be understood that, although electrical components 22 are shown in the drawings as being flat objects, the components may comprise semi-conductor devices, batteries, or other parts of electronic circuitry mounted on substrate 20 of the circuit board assembly performing a variety of functions.

Figure 2:
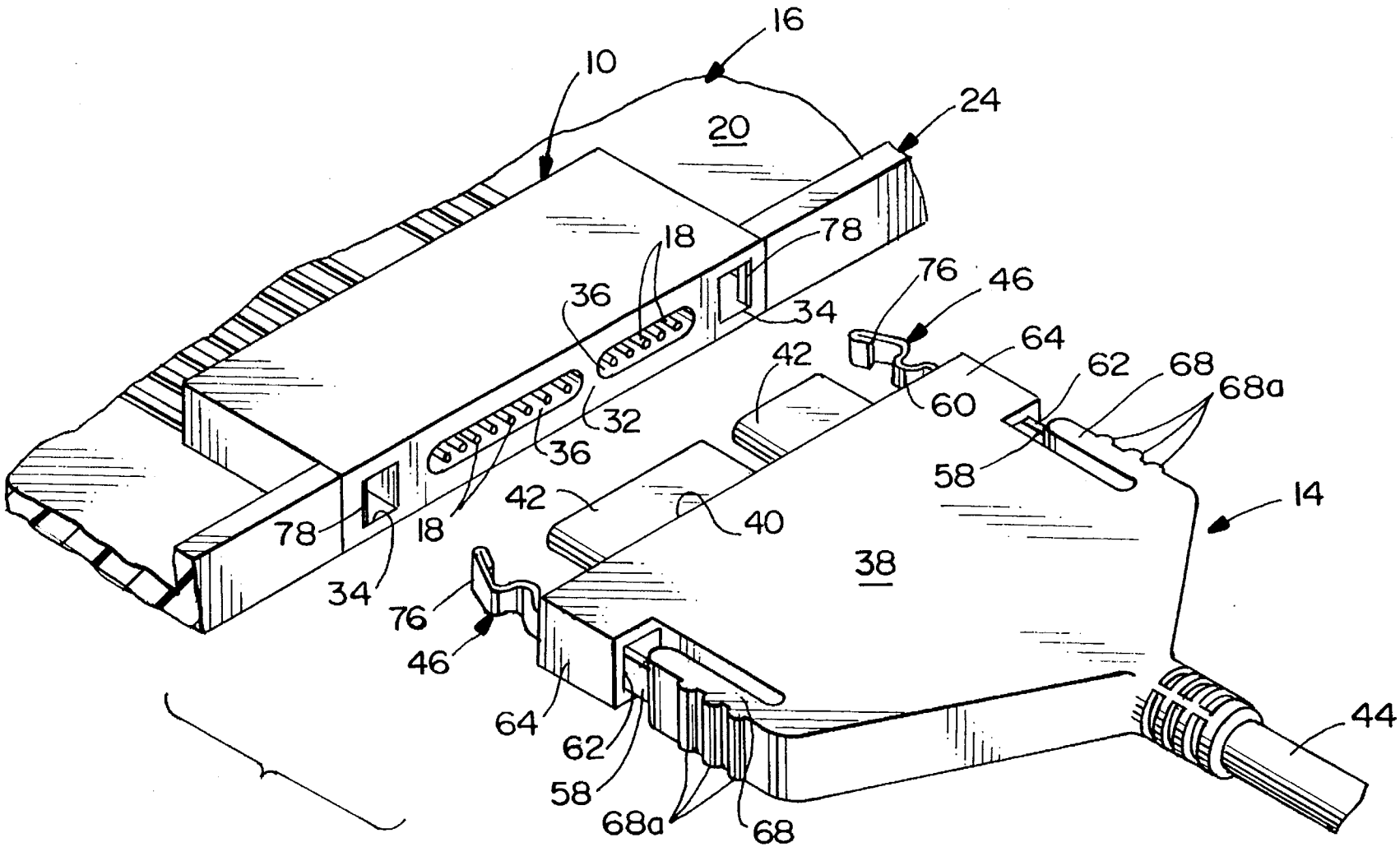
FIG. 2 is a fragmented perspective view looking at the mating end of a receptacle connector on the IC card along with the I/O connector.

Referring to FIG. 2 in conjunction with FIG. 1, receptacle connector 10 is mounted within frame 24 at the front edge of circuit board assembly 16 on or about substrate 20, as described above. The receptacle connector includes a housing 30 of dielectric material, such as molded plastic or the like. The housing has a mating end or face 32 with a pair of outside apertures 34 on opposite sides of a pair of inside apertures 36 within which input terminals 18 project.

I/O connector 14 includes a housing 38 of dielectric material, such as molded plastic or the like. Housing 38 includes a complementary mating end or face 40 for interfacing with mating face 32 of receptacle connector 10. A pair of plug portions 42 project from mating face 40 of housing 38 of the I/O connector for insertion into apertures 36 in receptacle connector 10. The plugs and the apertures are of different sizes or lengths for polarization purposes. Appropriate terminals (see FIG. 3) are encased within housing 38 for electrical coupling to terminals 18 of receptacle connector 10. The terminals of I/O connector 14 are electrically connected to electrical wires within a cable assembly 44 coupled to the rear of the I/O connector. A pair of latch arms, generally designated 46, each have a free end as shown in FIG. 2, for insertion into a corresponding outside aperture 34 in mating face 32 of receptacle connector 10.

Figure 3:
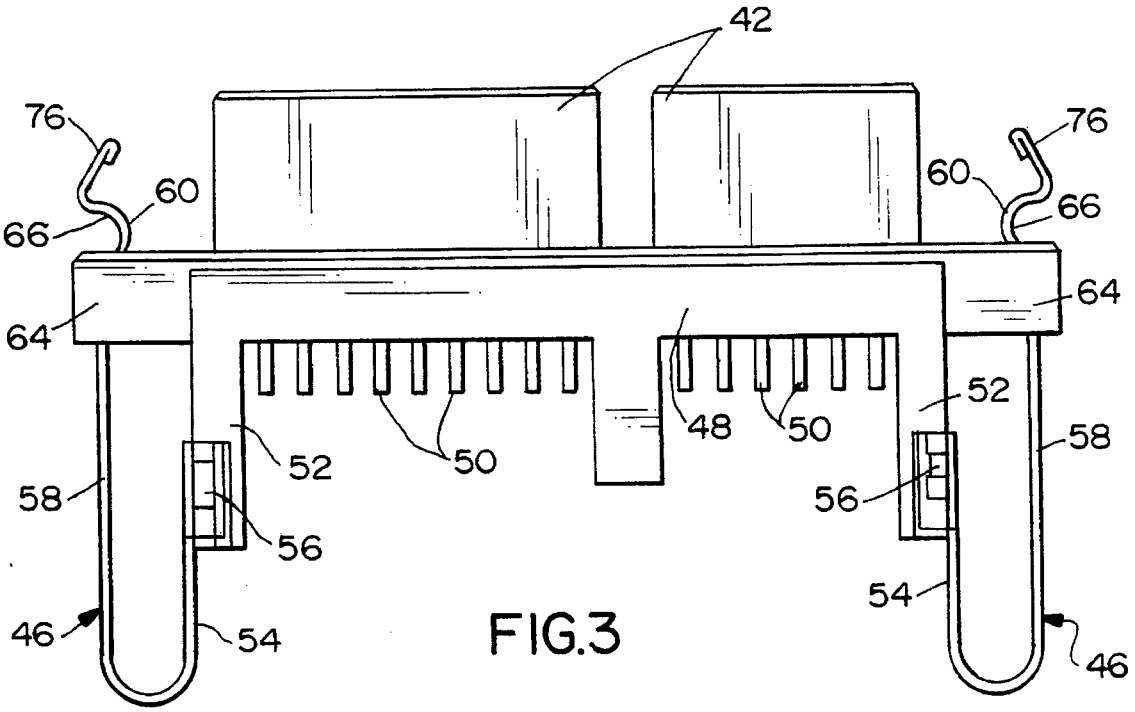
FIG. 3 is a top plan view of the I/O connector in its condition prior to overmolding.

Referring now to FIG. 3, the I/O connector is now described in its pre-assembled state, i.e. prior to overmolding. It can be seen that plug portions 42 actually project forwardly of a dielectric insert 48 which mounts a plurality of terminals 50 that interconnect with terminals 18 of receptacle connector 10 and that are terminated to the wires of cable 44. Dielectric insert 48 has a pair of rearwardly projecting arms 52 to which latch arms 46 are initially secured.

Still referring to FIG. 3 in conjunction with FIGS. 1 and 2, the latch arms are fabricated of stamped and formed sheet metal material. It can be seen in FIG. 3 that each latch arm is generally U-shaped with a short leg 54 terminating in a clip 56 and a long leg 58 terminating in a latch hook 60. Clips 56 of the latch arms are secured to arms 52 of dielectric insert 48 for mounting the latch arms prior to overmolding the I/O connector. The long legs 58 of the latch arms form cantilevered latching structures, and the long legs project through holes 62 (FIG. 2) formed through ears 64 projecting laterally outwardly of plug portions 42. Lastly, it can be seen clearly in FIG. 3 that latch hooks 60 of the latch arms are formed with radiuses and define curved latching surfaces 66 for purposes described hereinafter.

Figure 4:
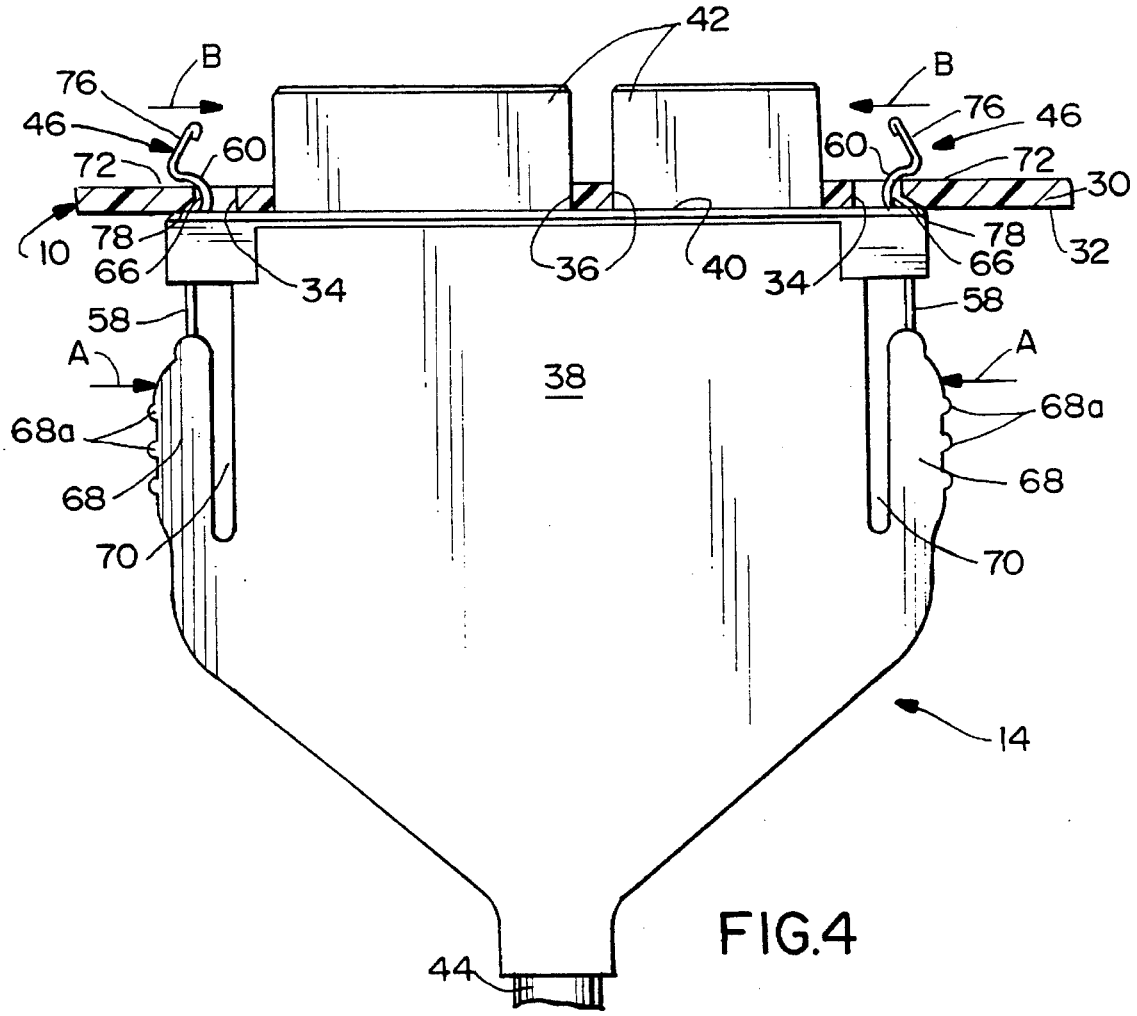
FIG. 4 is a top plan view partially cutaway of the overmolded I/O connector fully latched within the mating face of the IC card receptacle connector.

Referring to FIG. 4 in conjunction with FIG. 3, it can be seen that dielectric insert 48 (FIG. 3) and latch arms 46 have been overmolded with dielectric housing 48 of I/O connector 14. The plastic material of the housing is overmolded, as at 68, over a portion of the lengths of long legs 58 of latch arms 46 leaving gaps 70 between overmolded portions 68 and the body of housing 38. Therefore, the latch arms effectively are cantilevered from opposite sides of housing 38. The outside surfaces of overmolded portions 68 are molded with textured ribs **68*a* to facilitate manual gripping or pinching of the cantilevered latch arms. A user can grip I/O connector 14 and squeeze or pinch inwardly on overmolded portions 68 in the direction of arrows "A" to deflect latch arms 46 (i.e. long legs 58 and hook portions 60 of the latch arms) inwardly in the direction of arrows "A". This effectively enables I/O connector 14 to be unmated from receptacle connector 10** with minimal force, as described hereinafter.

Still referring to FIG. 4, I/O connector 14 is shown fully mated with receptacle connector 10, with plug portions 42 of the I/O connector projecting into apertures 36 of the receptacle connector and latch hooks 60 of the latch arms projecting through apertures 34 of the receptacle connector. It can be seen that each latch hook 60 of each latch arm has latchingly engaged a corresponding latching surface 72 on the internal outer edge of each aperture 34 in mating face 32 of housing 30 of the receptacle connector. It also can be seen that this engagement is along the radiused surface 66 on the outside of each latch hook 60.

In order to facilitate mating of connectors 10 and 14, latch arms 46 are provided with oblique lead-in lips 76 which are angled inwardly in order to engage the outside edges of apertures 34 in housing 30 of receptacle connector 10 as the free ends of the latch arms are inserted into the apertures. Aperture lead-in areas or chamfers 78 provide a camming surface which cooperates with lead-in lips 76 to facilitate insertion of the connectors. In essence, upon mating the connectors, lips 76 bias the latch arms inwardly in the direction of arrows "B" (FIG. 4) to facilitate deflection of the latches in the absence of manual actuation thereof. Once latch hooks 60 pass latching surfaces 72, the free ends of the latch arms will snap back outwardly, opposite the direction of arrows "B" to the latching positions shown in FIG. 4. Of course, if it is desired to mate the connectors with minimal force, a user can squeeze or pinch overmolded portions 68 to bias the latch arms inwardly in the direction of arrows "A", whereupon lips 76 will pass freely through apertures 34 without engaging any portion of the housing about the apertures.

Lastly, as stated above, legs 58 of latch arms 46 project through holes 62 (FIG. 2) in ears 64 which project outwardly of the body of I/O connector 14. This structural arrangement provides an anti-overstress means on housing 38 of I/O connector 14 to confine the range of outward deflection of the latch arms. In other words, if lip 76 or hook portion 64 of one of the latch arms becomes entangled with an extraneous object, and forces are exerted on the latch arm in an outwardly direction, the range of deflection of leg 58 of the latch arm will be limited to within hole 62 of housing ear 64 to prevent the latch arm from being flexed too far away from the connector housing, thereby preventing damage to the latch and preserving its spring characteristics. Overmolded portions 68 of housing 38 also prevent localized stressing of the metal material of the latch arms.

Figure 5:
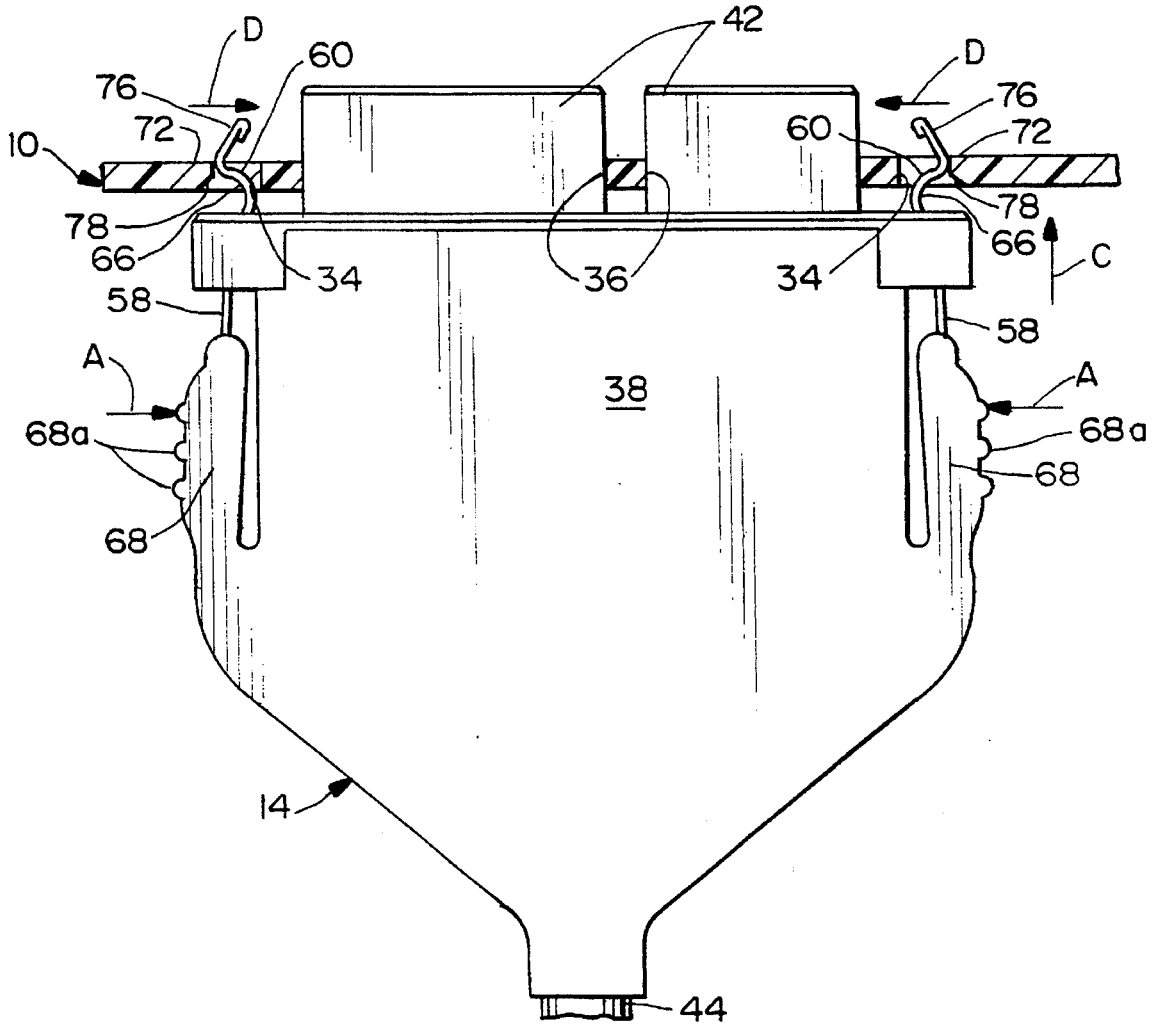
FIG. 5 is a view similar to that of FIG. 4, with the I/O connector having been partially unmated from the receptacle connector.

In operation, reference is made to FIG. 5 which can represent either a partially mated or a partially unmated condition of receptacle connector 10 and I/O connector 14. When it is desired to mate the connectors, a user has two options. First, I/O connector 14 can be moved in the direction of arrow "C" without manually actuating or depressing the latch arms, whereupon oblique lead-in lips 76 will engage the outer edges of apertures 34 and deflect the latch arms inwardly in the direction of arrows "D" as the connectors are mated. In the alternative, overmolded portions 68 of housing 38 can be pinched inwardly in the direction of arrows "A" which, effectively, performs the same function as deflecting lips 76 inwardly in the ! direction of arrows "D". However, by manually deflecting the latch arms, the connectors are mated with minimal forces, whereas direct mating of the connectors result in mating forces determined by the angle and radius of lead-in lips 76 and hook portions 60, respectively.

When it is desired to unmate connectors 10 and 14, unmating actions also can be carried out in two different manners. First, a user again can pinch inwardly on overmolded portions 68 to deflect the latch arms inwardly and unmate the connectors with minimal forces as latch hooks 60 and lips 76 of the latch arms pass freely out of apertures 34. On the other hand, and this may occur primarily as a result of accidental or unintentional pulling on I/O connector 14, the connectors can be directly unmated simply by the application of opposed (unmating) forces on the connectors. These unmating forces are determined by the oblique angle of lead-in legs 76 and the size and location of the radii which define surfaces 66 of latch hooks 60. These unmating forces, obviously, will be greater than the minimal unmating forces afforded when a user pinches overmolded portions 68 and deflects the latch arms inwardly to clear latch hooks 60 of apertures 34. These "direct" unmating forces defined by radiused surfaces 66 prevent damage to the connectors or the latching system in the event of accidental or unintentional pulling on I/O connector 14, as by pulling on cable 44.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A locking system for an electrical connector assembly, comprising:

a first electrical connector including a housing having a mating face and a latching surface facing in a direction generally opposite said mating face; and a second electrical connector including a housing having a complementary mating face for interfacing with the mating face of the first connector and a metal spring latch arm cantilevered from a rearward portion of the second connector with a radiused hook portion for latchingly engaging the latching surface of the first connector, the latch arm being located for manual deflection to move said hook portion out of engagement with the latch shoulder to allow unmating of the connectors with a minimal force, and the hook portion intersecting the latching surface along a radius to produce a lateral force for deflecting the latch arm in response to an unmating force applied directly to the connectors that is greater than said minimal force.

2. The locking system of claim 1 wherein said latch arm is cantilevered from a side of the housing of said second connector whereby the latch arm is deflectable inwardly toward the housing.

3. The locking system of claim 2, including a second latch arm cantilevered from an opposite side of the housing of said second connector whereby the latch arm can be conjointly manually deflected by a pinching action against the opposite sides of the housing.

4. The locking system of claim 1 wherein a distal end of said latch arm includes an oblique lead-in lip for engaging a portion of the housing of the first connector and biasing the latch arm to a deflected position upon mating of the connectors.

5. The locking system of claim 1, including anti-overstress means on the housing of the second connector to limit the range of deflection of the latch arm.

6. The locking system of claim 1 wherein a base portion of said latch arm is overmolded by a portion of the housing of said second connector.

7. A locking system for an electrical connector assembly, comprising:

a first electrical connector including a housing having a mating face and a latching surface facing in a direction generally opposite said mating face; and a second electrical connector including a housing having a complementary mating face for interfacing with the mating face of the first connector and a pair of metal spring latch arms having hook portions for latchingly engaging the latching surface of the first connector, the latch arms being cantilevered from opposite sides of the housing whereby the latch arms can be manually deflected to effect unmating of the connectors with a minimal force, the hook portions being configured generally with a radius which produce a lateral force to deflect the latch arms in response to an unmating force applied directly to the connectors that is greater than said minimal force, and the latch arms including oblique lead-in lips at distal ends of the arms for engaging portions of the housing of the first connector and biasing the latch arms to a deflected position upon mating of the connectors.

8. The locking system of claim 7, including anti-overstress means on the housing of the second connector to limit the range of deflection of the latch arms outwardly of the housing.

9. The locking system of claim 7 wherein portions of the latch arms are overmolded by portions of the housing of the second connector.

* * * * *